US012338591B2

(12) United States Patent
Carey et al.

(10) Patent No.: US 12,338,591 B2
(45) **Date of Patent: *Jun. 24, 2025**

(54) TEMPORARY FLEXIBLE PAVEMENT MARKERS

(71) Applicant: TrafCo Industries, Inc., Eagle Lake, TX (US)

(72) Inventors: Lesley M. Carey, Eagle Lake, TX (US); Lonny E. Daley, Eagle Lake, TX (US)

(73) Assignee: TrafCo Industries, Inc., Eagle Lake, TX (US)

( * ) Notice: Subject to any disclaimer, the term of this patent is extended or adjusted under 35 U.S.C. 154(b) by 431 days.

This patent is subject to a terminal disclaimer.

(21) Appl. No.: 17/978,891

(22) Filed: Nov. 1, 2022

(65) Prior Publication Data

US 2023/0068480 A1 Mar. 2, 2023

Related U.S. Application Data

(63) Continuation of application No. 15/668,154, filed on Aug. 3, 2017, now Pat. No. 11,519,144, which is a (Continued)

(51) Int. Cl.

| | |
|---|---|
| ***E01F 9/565*** | (2016.01) |
| ***E01F 9/524*** | (2016.01) |
| ***E01F 9/576*** | (2016.01) |

(52) U.S. Cl.

CPC ..... *E01F 9/573* (2016.02); *E01F 9/524* (2016.02); *E01F 9/578* (2016.02)

(58) Field of Classification Search

CPC ..... E01F 9/524; E01F 9/573; E01F 9/578

(Continued)

(56) References Cited

U.S. PATENT DOCUMENTS

| | | | |
|---|---|---|---|
| 1,676,843 | A | 7/1928 | Stephens |
| 1,746,312 | A | 2/1930 | Lee |

(Continued)

FOREIGN PATENT DOCUMENTS

| | | | |
|---|---|---|---|
| CA | 2155398 | A1 | 7/1996 |
| EP | 989239 | A2 | 3/2000 |

(Continued)

OTHER PUBLICATIONS

International Search Report and Written Opinion of the International Searching Authority in International Patent Application No. PCT/US2013/076558 mailed Apr. 15, 2014 (14 pages).

(Continued)

*Primary Examiner* — Raymond W Addie
(74) *Attorney, Agent, or Firm* — Pizarro Allen PC

(57) ABSTRACT

A temporary flexible pavement marker comprising a base, a stand and a protective shield wherein at least part of the stand is reflective and the protective shield is configured to prevent materials sprayed down upon the temporary flexible pavement marker from obscuring the reflective part of the stand may be employed in the construction or repair of roads. Since the protective shield prevents asphalt from obscuring the reflective part of the stand during spraying operations there is no need for removal of a protective layer from the markers after a spraying operation.

20 Claims, 8 Drawing Sheets

Related U.S. Application Data continuation-in-part of application No. 14/654,278, filed as application No. PCT/US2013/076558 on Dec. 19, 2013, now abandoned.

(60) Provisional application No. 61/749,058, filed on Jan. 4, 2013.

(58) Field of Classification Search
USPC ..... 404/10
See application file for complete search history.

(56) References Cited

U.S. PATENT DOCUMENTS

| | | | | |
|---|---|---|---|---|
| 1,766,073 | A | 6/1930 | Hartzler et al. | |
| 1,833,124 | A | 11/1931 | Rand | |
| 1,928,447 | A | 9/1933 | Cornell, Jr. | |
| 3,784,279 | A | 1/1974 | Hedgewick | |
| 4,061,435 | A * | 12/1977 | Schmanski | E01F 9/627 40/608 |
| 4,237,191 | A | 12/1980 | Horne | |
| 4,445,803 | A | 5/1984 | Dixon | |
| 4,462,711 | A | 7/1984 | Garner | |
| 4,521,129 | A | 6/1985 | Krech et al. | |
| 4,991,994 | A | 2/1991 | Edouart | |
| 5,460,115 | A | 10/1995 | Speer et al. | |
| 6,505,994 | B1 | 1/2003 | Attar | |
| D471,125 | S | 3/2003 | Farley | |
| 6,764,249 | B2 | 7/2004 | Stone | |
| 7,690,861 | B1 * | 4/2010 | Johnson | E01F 9/553 404/12 |
| 7,866,914 | B2 | 1/2011 | Kulp et al. | |
| 8,342,700 | B2 | 1/2013 | Naik et al. | |
| D860,845 | S | 9/2019 | Carey et al. | |
| 11,047,097 | B2 | 6/2021 | Carey et al. | |
| 11,519,144 | B2 | 12/2022 | Carey et al. | |
| 2003/0194270 | A1 | 10/2003 | Forrer | |
| 2004/0114997 | A1 | 6/2004 | Stone | |
| 2011/0293367 | A1 | 12/2011 | Yeghiayan et al. | |
| 2012/0092767 | A1 | 4/2012 | Naik et al. | |
| 2013/0108362 | A1 | 5/2013 | Philip | |

FOREIGN PATENT DOCUMENTS

| | | | |
|---|---|---|---|
| EP | 2337824 | A1 | 6/2011 |
| WO | 2010036522 | A1 | 4/2010 |
| WO | 2014107326 | A1 | 7/2014 |

OTHER PUBLICATIONS

Pexco, Plastic Extrusion & Plastic Injection Molding Company in Tacoma, WA, www/pexco.com/locations/Tacoma-wa/, accessed Jan. 17, 2019 (2 pages).

Pexco, "Temporary Road Markers," dated Feb. 13, 2019 (1 page).

Pexco, Davidson Traffic Control Products, brochure entitled "Flexible Chip Seal Marker," https://www.pexco.com/media/2002/flexible-chip-seal-markers-overview.pdf, dated Feb. 13, 2019 (2 pages).

Pexco, brochure entitled "Davidson TRPM™ Chip Seal Markers Installation Procedures," https://www.pexco.com/media/2001/davidson-trpm-installation-procedure.pdf, accessed Feb. 13, 2019 (1 page).

Hiway Safety, "Chip-Seal Markers, Covered," http://www.hiwaysafety.com/index.php/chip-seal-markers-covered.html, accessed Jan. 17, 2019 (1 page).

Apex, "Manufacturer of Reflective and Non-Reflective Pavement Markers," http://www.apexmarker.com/chip_seal_temporary.html, accessed Jan. 17, 2019 (3 pages).

Apex, brochure entitled "Model 932 Chip Seal/Overlay Markers," http://apexmarker.com/pdf/specifications/SPEC%20-%20CHIP%%20SEAL.pdf, dated Feb. 13, 2019 (1 page).

Eberliron, "Chip Seal Markers," https://eberliron.com/store/category/Chip_Seal_Markers/1476.html, accessed Jan. 17, 2019 (1 page).

Alpine Products, Inc., "TRPM Chip Seal Marker," https://www.alpinemarkings.com/products/trpm-chip-seal-marker/, accessed Jan. 17, 2019 (1 page).

Transline, Inc., "Reflective Flexible Road Tabs," https://translineinc.com/products/pavement-marking-supplies/reflective-flexible-road-tabs/, accessed Feb. 13, 2019 (1 page).

Texas Department of Transportation, "DMS-8242 Temporary Flexible, Reflective Roadway Marker Tabs," ftp://ftp.dot.state.tx.us/pub/txdot-info-cst/DMS/8000-series/pdfs/8242.pdf, accessed Feb. 13, 2019 (4 pages).

Texas Department of Transportation, "Temporary Flexible, Reflective Roadway Marker Tabs," ftp://ftp.dot.state.tx.us/pub/txdot-info/cmd/mpl/tfrmt.pdf, accessed Feb. 13, 2019 (2 pages).

Correspondence from Trafco Industries, Inc. to Texas Department of Transportation, dated Jan. 29, 2015 (1 page).

Notice of Approval for Trafco Industries, Inc.'s temporary flexible pavement markers dated Mar. 20, 2015 (2 pages).

Mississippi Department of Transportation, "Producer/Supplier Materials Report" printed Sep. 10, 2018 (1 page).

Traffic & Transit, "Chip Seal Tab," https://www.trafficandtransit.com/chip-seal-tab, accessed Feb. 13, 2019 (10 pages).

Texas Asphalt, published by the Texas Asphalt Pavement Association, Fall 2018 (47 pages).

* cited by examiner

TEMPORARY FLEXIBLE PAVEMENT MARKERS

CROSS-REFERENCE TO RELATED APPLICATION

This application is a continuation of U.S. Non-Provisional patent application Ser. No. 15/668,154 entitled "Temporary Flexible Pavement Markers" filed Aug. 3, 2017, which is a continuation-in-part of U.S. Non-Provisional patent application Ser. No. 14/654,278 entitled "Temporary Flexible Pavement Markers" filed Jun. 19, 2015, which is a national stage entry under 35 U.S.C. 371 of International Patent Application No. PCT/US2013/076558 entitled "Temporary Flexible Pavement Markers" filed Dec. 19, 2013, which claims priority to U.S. Provisional Patent Application 61/749,058, entitled "Temporary Flexible Pavement Markers" filed Jan. 4, 2013, each of which are hereby entirely incorporated herein by reference.

FIELD

The application relates to pavement markers, and particularly to temporary flexible pavement markers.

BACKGROUND

During highway construction and repair, it may be necessary to route traffic over streets that are incomplete or undergoing reconstruction. During such operations, it is not unusual for accidents to occur in work zones where the edges of the traffic lanes are not clearly marked. This is especially true in the construction of new roads between the time that a subsurface is laid down and the final application of asphalt.

Periodic road maintenance normally includes pavement resurfacing using either a chip, slurry, or road seal compound that is applied over the original surface to restore and protect it. When this is done, the existing painted traffic lines, be they centerlines, passing lines, no passing lines, turn lane lines, or any other traffic painted line will be covered and thereby obliterated and no longer visible.

Even after asphalt is applied to a road surface, is not unusual for there to be a period of time between the application of the asphalt and the installation of permanent lane markers. One solution to this problem is the use of temporary pavement markers. These temporary pavement markers are typically formed of a resilient plastic material having a base portion and an upwardly extending reflective portion that will extend up through each coating applied to the road surface during the pavement operation. Such temporary pavement markers are typically designed to last long enough for the entire resurfacing project to be completed, and up to and including the repainting of the various traffic lines upon the new surface. It would be desirable in the art of highway construction and maintenance to be able to employ temporary flexible pavement markers that may be installed and ready for use in a single step.

SUMMARY

A temporary flexible pavement marker may comprise a base configured for mounting to a road surface, a stand flexibly extending substantially perpendicularly from the base, the stand comprising a reflective portion not covered by any protective layer removable therefrom, and a protective shield extending from the stand above the reflective portion such that when the marker is installed on the road surface, the protective shield substantially shields the reflective portion from being obscured by fluid material sprayed down onto the road surface but does not substantially obscure reflection of light from the reflective portion to vehicles traveling on the road surface after the fluid material has been sprayed down onto the road surface.

DETAILED DESCRIPTION

In one embodiment, a temporary flexible pavement marker may comprise a base, a stand and a protective shield wherein at least part of the stand is reflective (either of itself or because of having a reflective tape attached thereto or a reflective paint applied thereon); The protective shield is configured to substantially prevent materials, such as asphalt, tar, oil, and water, that may be sprayed down upon the temporary flexible pavement marker from obscuring the reflective part of the stand.

Figure 1:
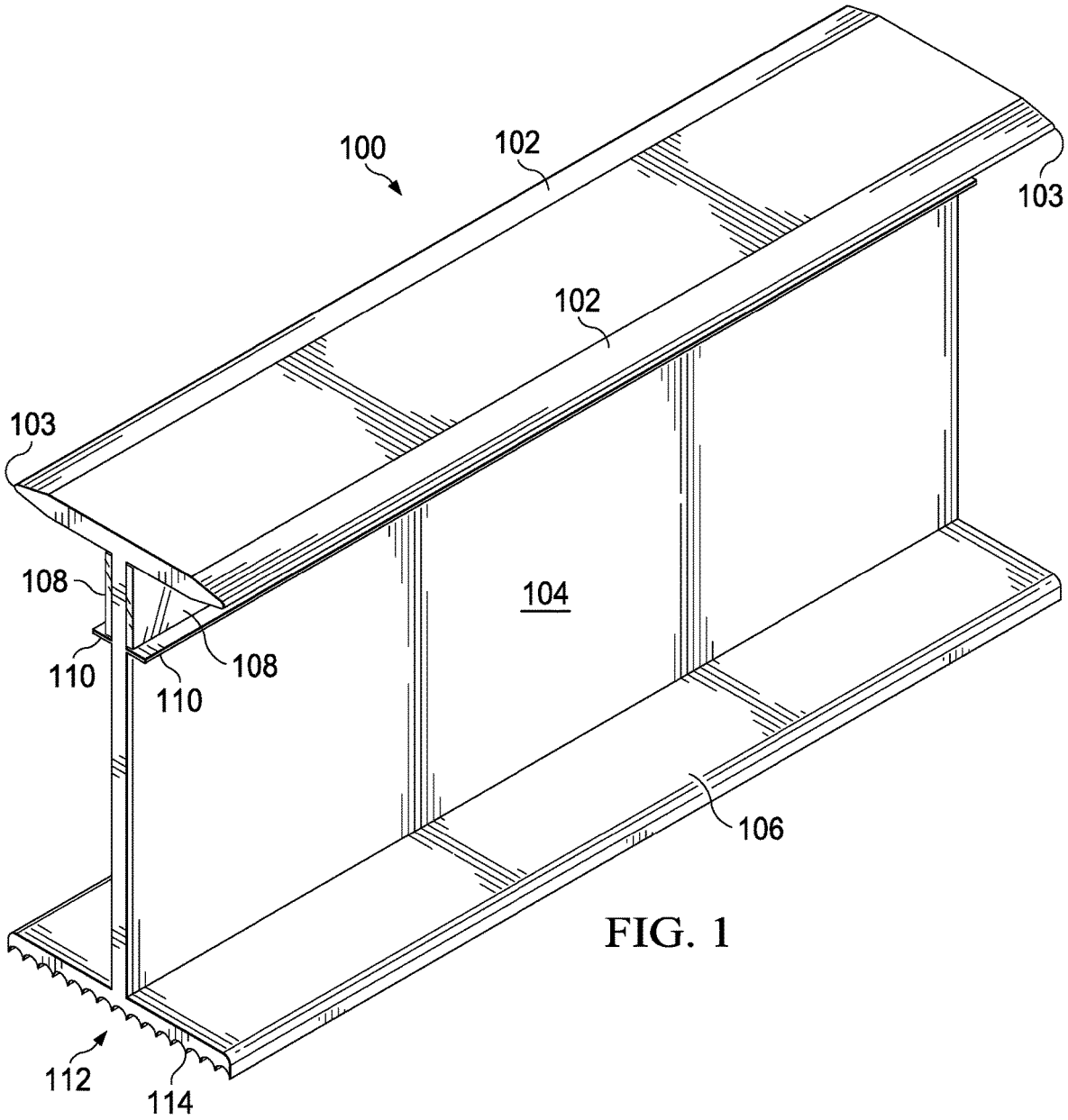
FIG. 1 illustrates one embodiment of a temporary pavement marker having a protection shield on two sides.

Turning to FIG. 1, one embodiment of a temporary flexible pavement marker 100 is illustrated in a perspective view showing a protective shield 102, a stand 104 and a base 106. In this configuration, the base 106 is disposed substantially normal to the stand 104 to create an inverted "T" configuration of the stand 104 and base 106. In other embodiments, the base 106 may be disposed substantially normal to the stand 104 to create an "L" configuration of the stand 104 and base 106. Of course, in various other embodiments, the stand 104 may extend at an angle incident to the base 106.

In some embodiments, the base 106 is configured for mounting the marker 100 to a road surface (not shown). In one embodiment, the mounting surface 112 of the base 106 may include one or more ridges 114. In some end uses of the temporary flexible pavement markers of the application, it may be desirable to retain a fluid such as tar or asphalt or epoxy other adhesive to improve the adhesion of the temporary flexible pavement marker to the pavement. The presence of ridges 114 serves to facilitate the retention of such fluid. In other embodiments, the mounting surface 112 of the base 106 may be hatched, or grooved, or provided with a roughened texture so as increase the surface area and thus improve adhesion to the surface on which the marker 100 is to be bonded. In yet other embodiments, any combination thereof may be used to better configure the mounting surface 112 for mounting to a road. Of course, the mounting surface 112 may also be smooth.

The protective shield 102 may be disposed at or near the upper terminus of the stand 104 and extend from the stand 104 to provide protection from spray originating from above the marker 100. In the embodiment of FIG. 1, the protective shield 102 is configured to protect both sides of the temporary flexible pavement marker. As such, the stand 104 may be coincident with the mid-plane of the protective shield 102 and creates an arm of the protective shield 102 extending over each lateral face of the stand 104. Allowing that there is a protective shield component to each side of the stand, the protective shield 102 may have, in some embodiments, an angle of incidence with the stand 102 of 45 degrees and such angle may be varied at the time of construction to optimize spray protection based on the width of the protective shield 102 overhang from the edge of the stand 104 and maintaining optimal visibility of any reflective surface disposed on the stand 104.

The protective shield may comprise a non-removable portion of the temporary flexible pavement marker, and may comprise the same material as the rest of the temporary flexible pavement marker. The protective shield may comprise any suitable thickness sufficient to maintain the protective shield, under a variety of typical road temperature conditions, in an orientation substantially shielding the reflective surface from spray delivered down to the road surface over the marker.

In some embodiments, a drip edge 103 of the protective shield may comprise a squared edge, a radius or a sharp edge. The protective shield 102 may be substantially normal to the stand 104 to create a "T". In the embodiment of FIG. 1, the protective shield, stand and base of the marker have a cross-sectional shape approximating an "I" shape.

The stand of the temporary flexible pavement marker may be at least partially reflective. In some embodiments, the reflective portion of the stand may be prepared by applying thereto a reflective tape or a reflective paint. In other embodiments, the stand itself may be formed of reflective material. The term "reflective" means that the subject surface is either retro reflective or prismatic to the extent that the temporary flexible pavement markers are sufficiently responsive to automobile headlights to safely delineate a traffic lane at night or other dark or limited-visibility driving conditions.

In the embodiment of FIG. 1, the stand 104 is reflective on both sides, and the reflectivity is provided by reflective tape 108. In other embodiments, the stand 104 may be reflective on one side. In some embodiments, the reflective portion 108 may be disposed in or on the stand 104 between the protective shield 102 and the base 108. The reflective portion 108 may be disposed so as to permit protection by the protective shield 102 from sprays originating from above the marker 100.

In some embodiments, a secondary protective rib 110 may be provided on the stand 104 to prevent back splashing from the surface of the road. The secondary rib 110 may run the entire length of the marker 100. Alternately, the entire rib 110 may comprise a series of rib sections along the length of the marker 100. In some embodiments, the series of rib sections may be spaced such that the surface tension of droplets and surface friction on the secondary rib sections prevents the droplets from passing beyond the secondary rib in which the secondary rib sections act much like an entrainment filter. The secondary ribs may comprise a solid member, or may comprise a row of tabs or bristles. The secondary rib may incidentally serve to protect the reflective surface 108 from damage. The damage may originate from a vehicle traversing over the marker or other environmental hazards that may be encountered.

In one embodiment, the point of intersection of the base and the stand is a living hinge. In another embodiment, the entire stand is flexible. Independent of the material used to construct the temporary flexible pavement markers, the markers may be configured such that when they are run over by an automobile, the material will rebound substantially to its original configuration so that the reflective surface will be visible to drivers.

Figure 2:
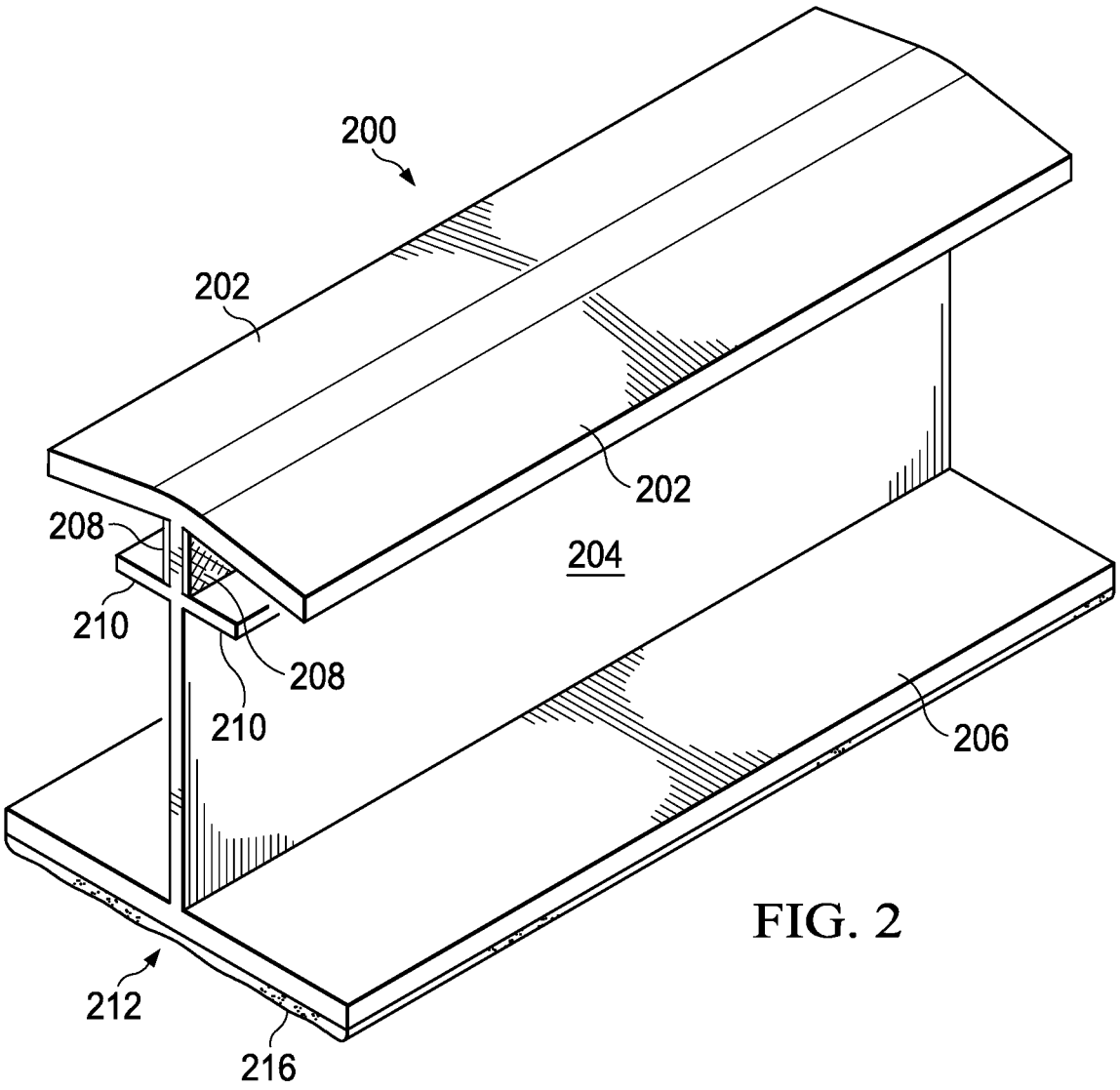
FIG. 2 illustrates another embodiment of a temporary pavement marker having a protection shield on two sides.

In other embodiments, as may be seen in FIG. 2, with an angle of incidence may be provided between the stand 204 of marker 200 and shield 202 so as to provide protection of the reflective portion 208 from sprays originating from above the marker 200. While an angle of 45 degrees is shown in FIG. 2, the angle of incidence between the protective shield 202 and stand 204 may be at any angle such that spray protection is optimized for the width of the protective shield 202, while still providing visibility to oncoming traffic of any reflective surfaces 108 disposed on the stand 204. As with the embodiment of FIG. 1, a secondary rib 210 may be provided so as to protect the reflective portion from backsplash from the road of sprays originating from above the marker 200. As may be seen in FIG. 2, an adhesive layer 216, such as tar or epoxy or butyl rubber, may be applied or affixed to the mounting surface 212 of the base 206. In some embodiments, an adhesive layer may be about ⅛-inch-thick, about ¾-inch wide, and about 4 inches long. The adhesive layer may be applied to the bottom face of the marker base at or near the time of marker installation. Alternately, the adhesive layer may be bonded to the marker at the time of construction of the marker with a removable protector (not shown), such as paper backing, applied to the exposed face of the adhesive layer. The protector may prevent accumulation of debris on the adhesive layer while in transit, and help ensure the adhesiveness of the adhesive layer does not degrade to unacceptable levels prior to marker installation.

Figure 3:
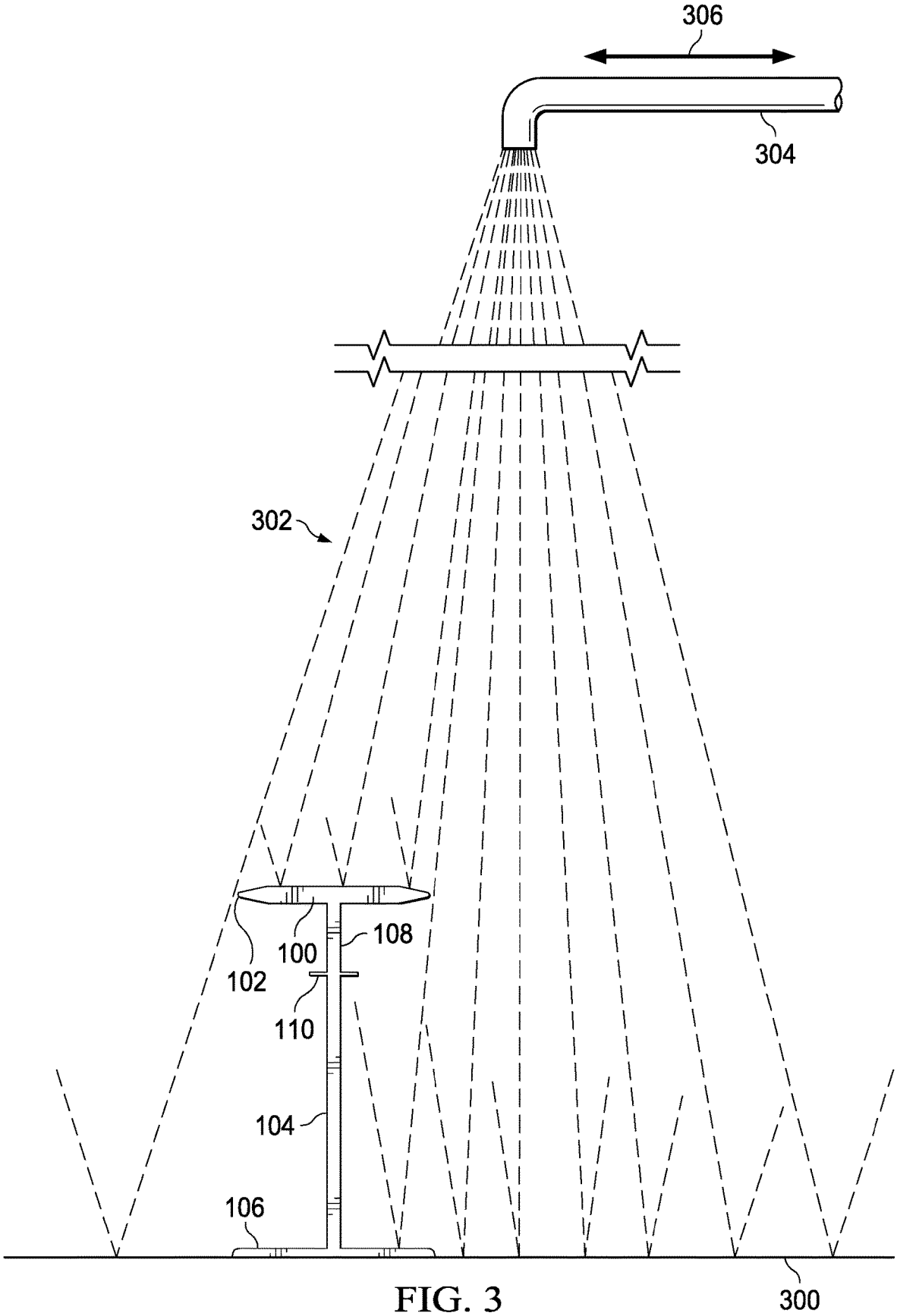
FIG. 3 illustrates road construction spray over a temporary pavement marker onto a road surface.

As may be seen in FIG. 3, the marker 100 of FIG. 1 may be mounted at its base 106 to a road surface 300 so as to mark a road boundary. A reflective surface 108 may be provided on each side of the stand 104. The protective shield 102 may extend from the stand so as to shield the reflective surface 108 from spray 302 originating from above the marker 100. The spray may originate from a sprayer 304 mounted to a truck or held by a road worker. As the sprayer 304 moves over the marker 100, spray 302 may be discharged down onto the road surface 300 and marker 100. The protective shield 102 will shield the reflective surface 108 from the spray, even if the spray 302 is delivered at an angle incident to the road 300. The secondary rib 110 may protect the reflective surface 108 from backsplash of spray 302 from the road surface 300 and/or base 106 of the marker 100. If multiple markers 100 are spaced apart in a line, such as to mark a road lane, the spray 302 may move across the multiple markers, and, for embodiments having a protective shield 102 on both sides of the stand 104, the protective shield 102 will protect the reflective surface 108 regardless of the direction 306 in which the sprayer 304 moves across the marker 100. As shown in FIG. 3, the protective shield 102 may extend a protective shield width that is greater than a protective rib width. Spray 302 projecting downwards is blocked from striking the secondary rib 110.

The width of the protective shield may be configured to optimize spray protection of the reflective surface without substantially interfering with visibility of any reflective material and on the associated face of the marker. Similarly, the width of the secondary rib may be configured to optimize spray back splash protection of the reflective surface without substantially interfering with visibility of any reflective material and on the associated face of the marker.

Thus, a protective shield may be provided in a variety of configurations. For embodiments comprising a protective shield extending substantially perpendicularly from the stand (such as in FIG. 1), the protective shield may extend about 0.5 inches from the surface of the stand. Thus, for a stand having a width of about 0.06 inches, the overall width of a marker having double-sided protective shields may be a little more than about 1 inch, such as about 1.06 inches. In some embodiments, the base may be about as wide as the protective shield, whether for double- or single-sided markers. The shield may extend from the stand at any suitable angle incident thereto. The shield may be substantially flat, or may be curved so as to form an arc-shaped protective cover above the reflective portion.

Similarly, a secondary rib may be provided in a variety of configurations. In some embodiments, a secondary rib may extend about 0.09 inches from the face of the stand. The secondary rib may be disposed at or near the edge of any reflective surface opposite the protective shield. The width or amount of extension from the stand by the secondary rib may be dependent on typical angles at which spray may be discharged from a spray nozzle. For example, fluid may be sprayed from a nozzle in a conical or fan shaped pattern. A secondary rib may, in some embodiments, be about 0.02 inches thick and about 0.09 inches wide.

For example, with reference to FIG. 1, a protective shield 102 extending from each side of the stand about 0.5 inches and a polyurethane rib 110 extending from each side of the stand about 0.09 inches may be considered suitable for an approximately 0.35 inch wide reflective strip 108 that is disposed between the protective shield 102 and secondary rib 110. In such embodiments, with the edges of the reflective strip 108 close to or abutting the edges of the protective shield 102 and rib 110, the reflective strip 108 may be substantially shielded from spray originating from above the marker. Other dimensions may be used for the shield 102, secondary rib 110 and reflective surface 108 if proportioned so as to provide substantial overhead and backsplash protection from spray delivered onto the road surface.

A temporary pavement marker may be provided in a variety of other configurations. For example, the marker 100 of FIG. 1 may be provided with a reflective surface on only one side of the stand 104. In other embodiments, the marker 100 may be provided with a reflective surface on both sides of the stand 104. In yet other embodiments, the marker 100 may be provided with no reflective surfaces any side of the stand 104. In such embodiments without a reflective portion between the protective shield and secondary rib, the reflective shield and secondary rib may protect a portion of the stand surface from being coated by spray from an overhead sprayer. Thus, if the marker has a white or yellow color, and the spray is black or a substantially different color than the marker, then at least a portion of the marker visible to oncoming traffic will not be covered by the spray and thus remain visually distinct from the road surface.

Figure 4:
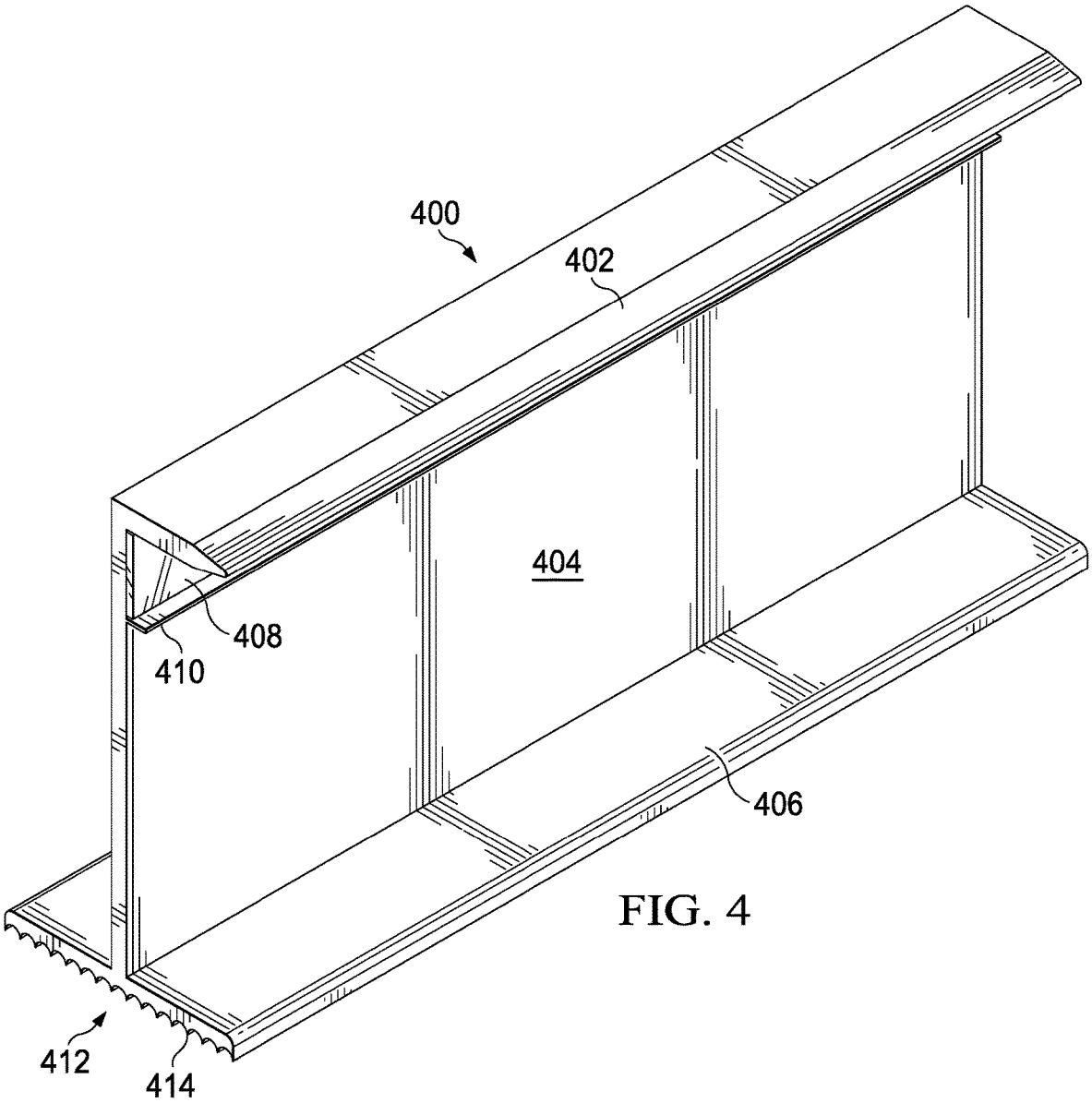
FIG. 4 illustrates one embodiment of a temporary pavement marker having a protection shield on one side.

In some embodiments, a one-sided temporary pavement marker may be provided. For example, as may be seen in the embodiment of FIG. 4, temporary flexible pavement marker 400 is illustrated in a perspective view showing a single protective shield 402 extending from one side of a stand 404, and a base 406. In this configuration, the base 406 is disposed substantially normal to the stand 404 so as to create an inverted "T" configuration of the stand 404 extending vertically from a horizontal base 406. In other embodiments, the base 406 may be disposed substantially normal to the stand 404 so as to create an "L" configuration of the stand 404 and base 406. Of course, in various other embodiments, the stand 404 may extend at an angle incident to the base 406. A single protective shield 402 may extend from the stand 404 so as to protect the reflective portion 408 from spray delivered from above the marker 400. A single secondary rib 410 may extend from the stand 404 so as to protect the reflective portion 408 from backsplash as described above. Such a one-sided marker 400 may be used in situations requiring a single reflective surface to better permit correct orientation on the road surface.

Figure 5:
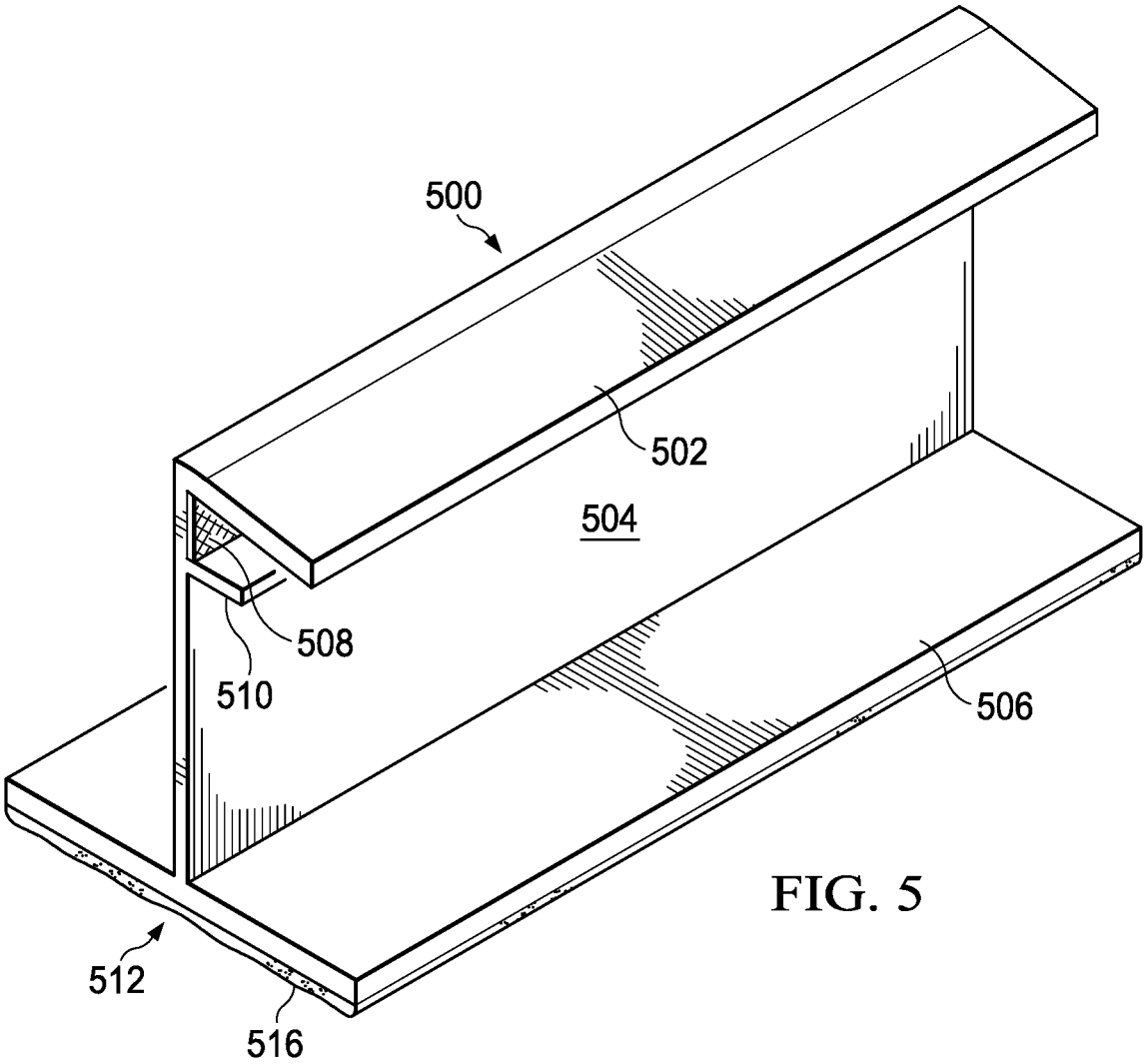
FIG. 5 illustrates another embodiment of a temporary pavement marker having a protection shield on one side.

Similarly, as may be seen in the embodiment of FIG. 5, a temporary flexible pavement marker 500 is illustrated in a perspective view showing a single protective shield 502 extending from one side of a stand 504 at an angle incident thereto, and a base 506. In this configuration, the base 506 is disposed substantially normal to the stand 504 so as to create an inverted "T" configuration of the stand 504 and base 506. In other embodiments, the base 506 may be disposed substantially normal to the stand 504 so as to create an "L" configuration of the stand 504 and base 506. A single protective shield 502 may extend from the stand 504 so as to protect the reflective portion 508 from spray delivered from above the marker 500. A single secondary rib 510 may extend from the stand 504 so as to protect the reflective portion 508 from backsplash as described above. Such a one-sided marker 500 may be used in situations requiring a single reflective surface to better permit correct orientation on the road surface.

Figure 6:
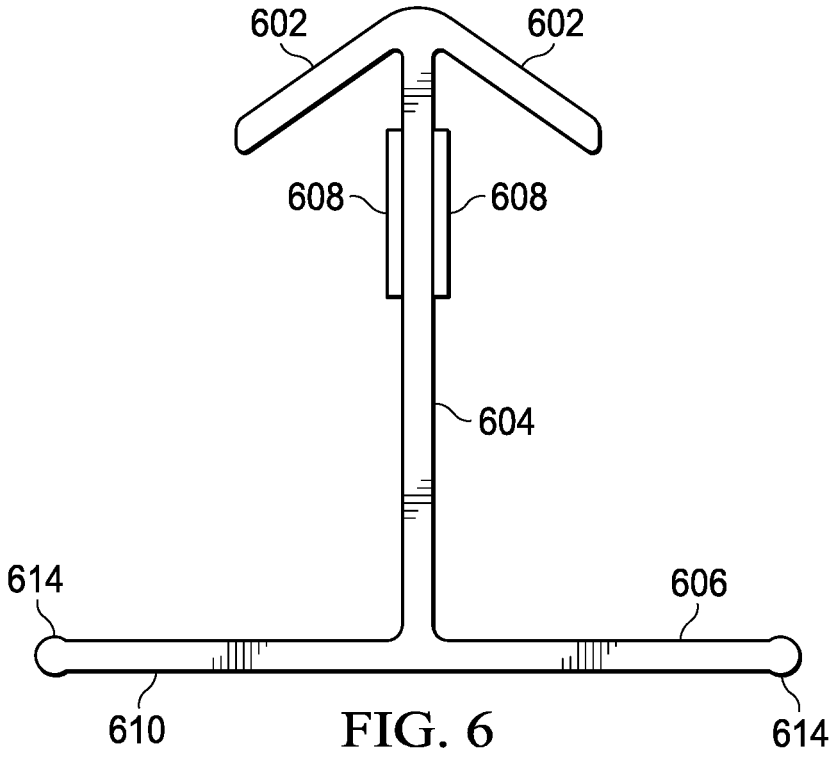
FIG. 6 illustrates an embodiment of a temporary pavement marker having a protection shield on two sides.
Figure 7:
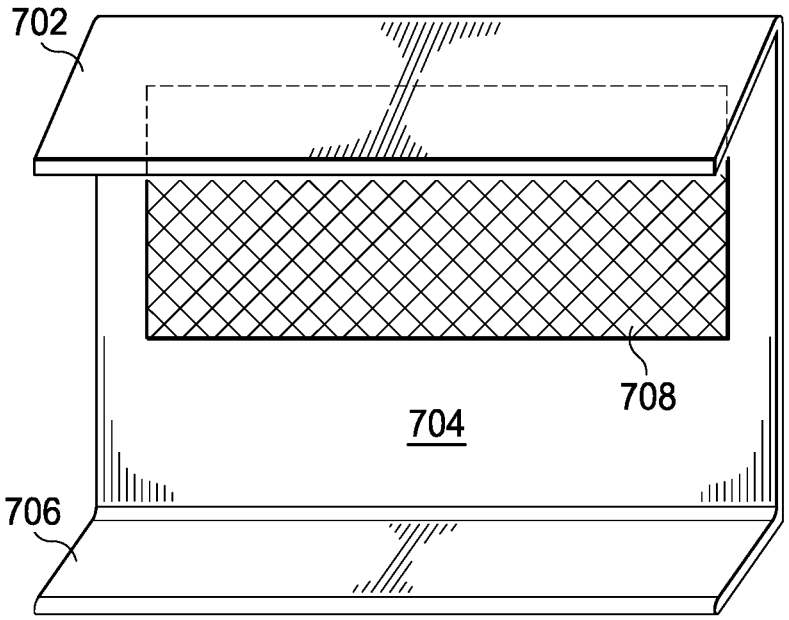
FIG. 7 illustrates another embodiment of a temporary pavement marker having a protection shield on one side.

In some embodiments, a secondary rib need not be used if the road surface will be sprayed at a pressure and height that will not substantially result in backsplash of spray from the road. In the embodiment of FIG. 6, for example, a temporary flexible pavement marker 600 is illustrated in elevation view showing a protective shield 602 extending from the stand 504 at an angle incident thereto, and a base 606. In one embodiment, the mounting surface 610 of the base may include one or more ridges 614. In this configuration, the base 606 is disposed substantially normal to the stand 604 so as to create an inverted "T" configuration of the stand 604 and base 606. A reflective portion 608 may be disposed on each side of the stand 604. In other embodiments, such as in the embodiment of FIG. 7, the base 606 may be disposed substantially normal to the stand 604 so as to create an "L" configuration of the stand 604 and base 606. In such one-sided embodiments, the reflective portion 608 may be disposed under the protective shield 602.

The temporary flexible pavement markers of the application may be prepared using any material known to be useful to those of ordinary skill in the art of making such items. For example, they may be prepared using plastics and/or metal. When the markers are made of plastic, the plastic used maybe one selected from the group consisting of: polyethylene, polypropylene, polyurethane, polyvinyl chloride, copolymers of polyethylene and polypropylene, and combinations thereof. Other plastics may also be used. Biodegradable materials of various types may be used. Useful metals include, but are not limited to, aluminum, spring steel, and the like. In some embodiments, the markers may be prepared using composites of metal and plastics. Various portions of the marker portions, such as base, stand, protective shield and secondary rib, may be sufficiently thick so as to permit the stand to substantially maintain shape under a variety of road conditions sufficient for the reflective surface thereof to reflect the headlights of vehicles traveling on the road, such as for roads situated in icy or desert conditions, and to substantially return to such shape if deformed by a passing vehicle or extreme road condition.

The reflective surface of the stand may cover a majority of the surface area of the stand, or a substantial portion thereof (such as in FIG. 7), or may exist as a narrower strip disposed at the upper (such as in FIG. 1), lower, or mid plane area of the face of the stand 102. In some embodiments, the reflective surface, such as reflective tape, may be between about ¼ inch and one-inch wide. The reflective surface may extend across the entire width of the marker, or may extend across only a portion or portions thereof.

The dimensions of the temporary flexible pavement markers of the application may be any that are useful for delineating traffic lanes. In some embodiments, the markers are about 4 inches wide and about 2 inches high. In these embodiments, a base in the "L" configuration may be from about 1 to about 2 inches wide while a base in a "T" configuration may be from about 1.5 to about 4 inches wide. In many venues, the governmental entity having responsibility for the maintenance and construction of highways may have a specification governing such dimensions.

Figure 8:
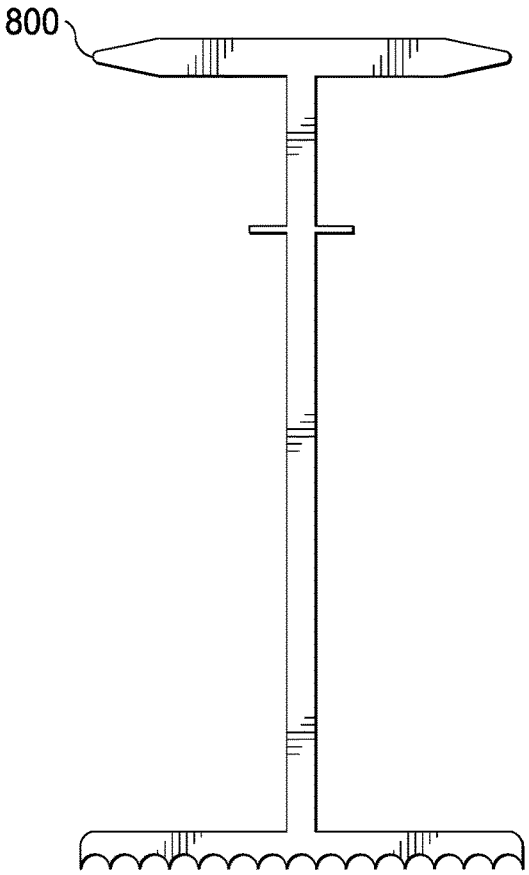
FIG. 8 illustrates an embodiment of a temporary pavement marker having a protection shield on two sides.
Figure 9:
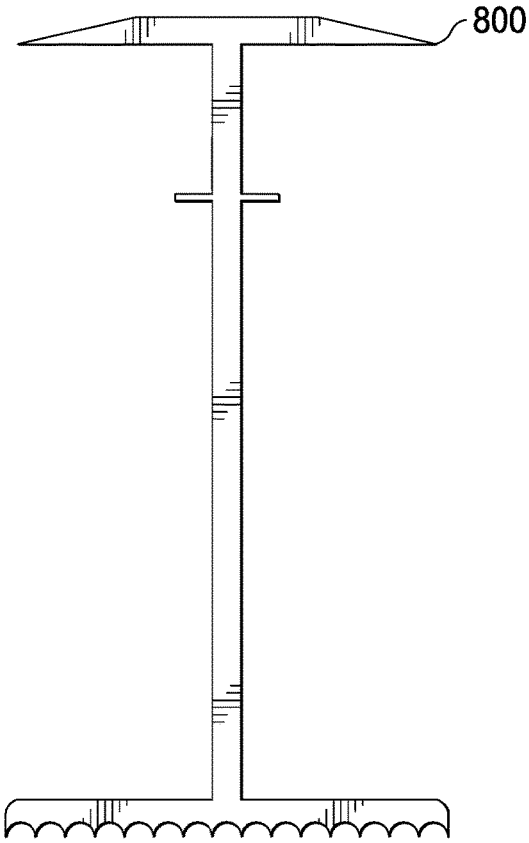
FIG. 9 illustrates yet another embodiment of a temporary pavement marker having a protection shield on two sides.
Figure 10:
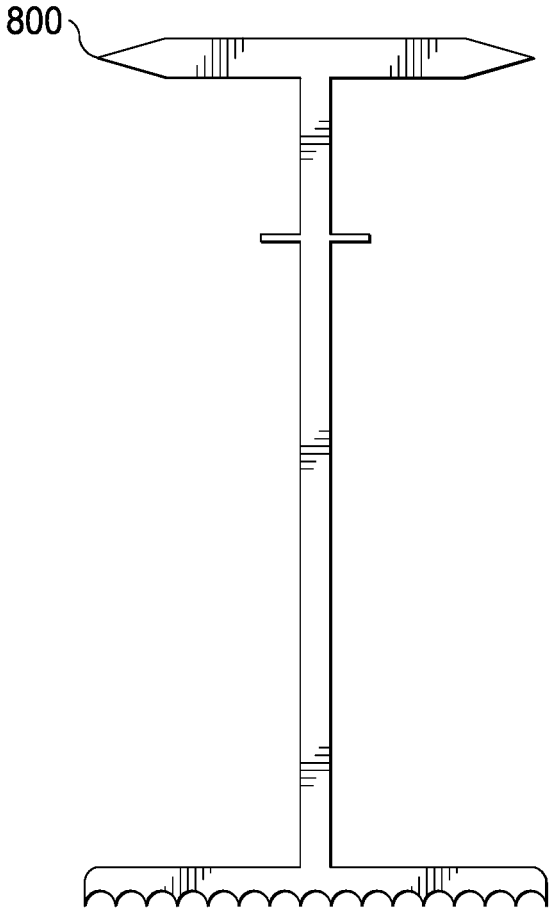
FIG. 10 illustrates an embodiment of a temporary pavement marker having a protection shield on two sides.

The protective shield of the temporary flexible pavement markers disclosed herein are integral to the marker (whether securely affixed thereto or forming a unitary article of manufacture therewith), and are configured to be non-removable from the stand. The purpose of this protective shield is to prevent or at least mitigate fluids such as asphalt, tar, or oil from obscuring the reflective surface of the stand during spraying. As noted above, such spraying may occur both in initial construction and in repairing roads. Accordingly, the protective shield may take a variety of suitable configurations according to the teachings hereof. For example, the protective shield edge 800 of the marker may be, as noted above, squared, curved, or chamfered, filleted or tapered, or provided with a radius, or any combination thereof, as may be seen in the embodiments of FIGS. 8, 9 and 10. Such embodiments are shown as two-sided, but may be formed as one-sided markers as described herein.

Figure 11:
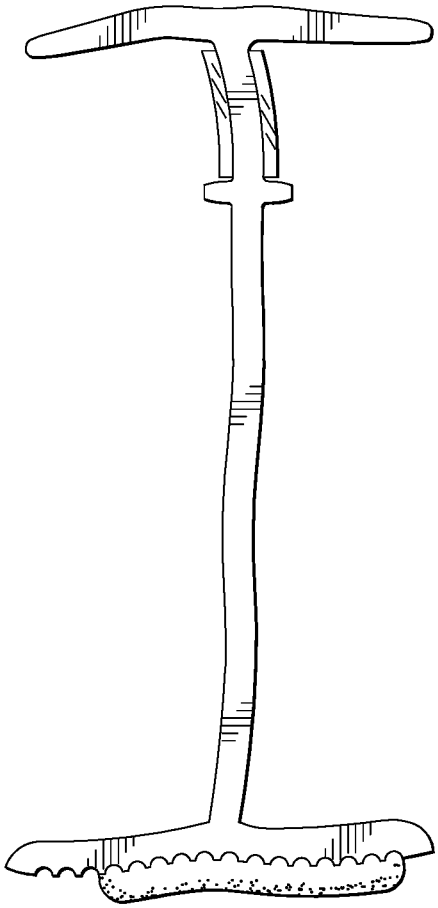
FIG. 11 illustrates the embodiment of FIG. 9 as manufactured.

It will also be appreciated that various marker embodiments shown herein are depicted in design form, and that various imperfections may exist in such markers as actually mass manufactured. For example, depending on the composition of the marker and method of manufacturing, a marker manufactured to have a tapered protective shield according to the embodiment of FIG. 9 may in physical reality manifest some or all of the various deviations and imperfections shown in FIG. 11 (such as warping and less apparent tapering). Similarly, installation and use of the temporary pavement markers may also result in deviations and imperfections. Such deviations or imperfections should be understood as falling within the scope of the present disclosure, and that use of terms such as "substantially" or "about" or "approximately" are intended to encompass such deviations and imperfections. Terms such as "perpendicular" or "vertical" or "L"-shaped or "T"-shaped or "normal" generally represent features approximately as designed, with the understanding that "vertical" may, in practice, may include substantial variance from true vertical, e.g., about 30 degrees from true vertical. Manufacturing tolerances for temporary pavement markers may be looser than for permanent pavement markers due to the relatively short life span or use of such markers. Such tolerances may be about +/−⅛ inch or even about +/−¼ inch. Temporary pavement markers are typically removed or replaced by construction crews, or degraded or destroyed by traffic or environmental conditions within weeks or months, rather than within years. In many cases, such markers are simply left in place after striping paint is applied or permanent markers are installed, and allowed to deteriorate or biodegrade over time.

During the repair or construction of a road, a subsurface is first prepared. Often asphalt is applied and then gravel is spread upon the road subsurface and fixed in place by the asphalt. In one embodiment of the method of the application, a temporary flexible pavement marker is placed upon the subsurface, next a spray of asphalt is applied (as shown in FIG. 3) and then gravel is spread on the road partially or fully covering the base of the temporary marker.

The asphalt spraying procedure is comparatively slow which results in the asphalt or other sealer being sprayed nearly straight down. Some of the figures show that the protective shield is angled down. In alternative embodiments, the orientation of the protective shield may be substantially perpendicular to the stand. The width of the protective shield, for a 4-inch by 2-inch temporary pavement marker, may thus be from ½ to 1 inch. These dimensions may be scaled or otherwise adjusted for temporary flexible pavement markers having different overall dimensions.

The temporary flexible pavement markers of the application may be configured to be reflective on one side or two sides. Reflective surfaces may be, for example, white, amber or silver. The markers reflective on one side would be useful for one-way traffic while the markers being reflective on both sides could be used for two-way traffic. It is also within the scope of the application that the markers be color coded in accordance with local ordinances to indicate one-way or two-way traffic, divisions between lanes, edges of lanes, and other traffic control information. For example, for one-way traffic, the marker could be white and for two-way traffic, yellow.

The temporary flexible pavement markers of the application represent a substantial improvement over the prior art. Prior art markers included one or more clear protective layers that had to be removed after a spraying operation. In practice, a crew of laborers would, prior to any asphalt spray work, lay down the temporary pavement markers to delineate traffic lines. For road repair, temporary pavement markers may be laid down over the top of the existing traffic lines. Typically, this is done in a coded fashion to indicate the existence of solid and broken traffic lines, turn lanes, and other traffic markings. One or more other layers of clear protective covering may be left in place on prior art markers. Since the layers of protective covers were clear, oncoming traffic could clearly see the reflective surfaces on the temporary pavement marker.

In a typical asphalt seal operation, a coating of liquid asphalt would be applied to the pavement which would coat the pavement and the reflective surfaces of the prior art temporary road markers, thereby obscuring the reflective portion of each temporary pavement marker. If the road were open during construction, the reflective surface of the markers would not serve to indicate—particularly at night—the location of the markers. Therefore, in order to restore the reflective properties of the temporary pavement markers, laborers would walk along the road from one temporary pavement marker to the next, stopping at each to remove the clear cover (or for markers with multiple clear protective layers, the outermost protective cover) in order to reveal the reflective properties of the temporary pavement markers, both for the safety of motorists and to serve as a guide for the paint truck that is soon to follow. This is a labor intensive, time consuming, and therefore expensive operation. For example, if this were to be done during a typical highway resurfacing of a portion of highway approximately eight miles long, it would take a crew of two people, each working from opposite ends of the resurfacing project and walking inward, approximately eight hours to stoop down and peel off so as to manually remove one protective coating from each of the temporary pavement markers along the entire eight miles. In addition to the time and cost of peeling off protective layers, removing such layers exposed laborers to traffic safety hazards.

In such situations, a technician was required to bend down or bend over to remove the protective layer from each marker. Since the number of markers employed in such operations may range from 500 to several thousand per mile, the cost for this was not insignificant. Placing the laborers in a slow-moving vehicle from which they might reach down and remove the protective cover might save some time and increase worker safety, but still such task had to be done.

Thus, a substantial advantage of the disclosed protective shield is that a temporary pavement marker may be provided without a protective cover, clear or otherwise, requiring removal. By providing a protective shield configured to substantially prevent asphalt or oil spray from obscuring the reflective surface, the need for the step of removing protective covers is eliminated. Furthermore, the temporary construction of the markers permits the stand to break off from the base over time (e.g., 45 days) after application of sufficient environmental stress, such as UV light and traffic impact.

In addition to the elements that are described, the temporary flexible pavement markers of the application may be prepared with any additional element known to be useful to those of ordinary skill in the art of making such objects. For example, in one embodiment, the temporary flexible pavement markers may have an adhesive applied to the bottom of the base. In most applications, the adhesive is a tacky adhesive and is protected from getting dirty by use of a paper or plastic tape. Thus, although the disclosed subject matter and its advantages have been described in detail, it should be understood that various changes, substitutions and alterations can be made herein without departing from the invention as defined by the appended claims. Moreover, the scope of the present application is not intended to be limited to the particular embodiments of the process, machine, manufacture, composition, or matter, means, methods and steps described in the specification. As one will readily appreciate from the disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, systems or steps.

We claim:

1. A temporary flexible pavement marker comprising:

a base configured for mounting to a road surface;

a stand flexibly extending from the base, the stand having a first side, the first side of the stand comprising a first reflective portion not covered by any protective layer that is configured for removal therefrom to lift road treatment material away from the first reflective portion when using the temporary flexible pavement marker during repair or construction of a road, and a first non-reflective portion extending from the base to the first reflective portion;

a first protective shield extending a protective shield width of about ½ inch to about 1 inch from the first side of the stand above the first reflective portion to substantially shield the first reflective portion from being obscured by fluid road treatment material when the temporary flexible pavement marker is positioned for use on a roadway surface and fluid road treatment material is sprayed down from above the temporary flexible pavement marker toward the road surface or base; and the first protective shield being configured to substantially shield the first reflective portion from the fluid road treatment material sprayed down from above the temporary flexible pavement marker toward the road surface or base without substantially interfering with visibility of the first reflective portion.

2. The temporary flexible pavement marker of claim 1 further comprising a first protective rib extending a protective rib width from the first side of the stand below the first reflective portion, the first protective rib width extending to substantially shield the first reflective portion from being obscured by backsplash of the sprayed fluid road treatment material from the road surface or base when the fluid road treatment material is sprayed down from above the temporary flexible pavement marker toward the road surface or base.

3. The temporary flexible pavement maker of claim 1 further comprising a first protective rib extending a protective rib width from the first side of the stand below the first reflective portion, the first protective shield extending said protective shield width from the first side of the stand to substantially block downward spray from striking the first protective rib when the fluid road treatment material is sprayed down from above the temporary flexible pavement marker toward the road surface or base.

4. The temporary flexible pavement maker of claim 1, further comprising a first protective rib extending a protective rib width from the first side of the stand below the first reflective portion, the first protective shield, first protective rib, and first reflective portion being proportioned to provide substantial overhead and backsplash protection from the fluid road treatment material when the fluid road treatment material is sprayed down from above the temporary flexible pavement marker toward the road surface or base.

5. The temporary flexible pavement marker of claim 1 further comprising:

a first protective rib extending a protective rib width from the first side of the stand below the first reflective portion;

the first protective rib being shorter than the first protective shield, the protective rib width and protective shield width being proportioned to provide substantial overhead and backsplash protection from the fluid road treatment material when the fluid road treatment material is sprayed down from above the temporary flexible pavement marker toward the road surface or base; and the first protective shield extending a protective shield width so that downwardly directed fluid road treatment material sprayed from above the flexible pavement marker is blocked from striking the first protective rib.

6. The temporary flexible pavement marker of claim 1 being a 4-inch long by 2-inch height temporary pavement marker.

7. The temporary flexible pavement marker of claim 1 further comprising a first protective rib, the first protective rib having a protective rib width of between about 0.02 inches to about 0.09 inches.

8. The temporary flexible pavement marker of claim 1 further comprising a second side opposite said first side, the second side including a second non-reflective portion, a second protective shield and a second protective rib.

9. A temporary flexible pavement marker comprising:

a base configured for mounting to a road surface;

a stand flexibly extending from the base;

a reflective portion not covered by any protective layer configured for removal therefrom so as to lift road treatment material away from the first reflective portion when using the temporary flexible pavement marker during repair or construction of a road;

a protective shield extending a protective shield width from the stand;

a protective rib extending a protective rib width from the stand;

the protective shield, protective rib, and reflective portion being proportioned so that the reflective portion is substantially protected from fluid road treatment material when the fluid road treatment material is sprayed down from above the protective shield toward the road surface or base and substantially protected from backsplash of the sprayed fluid road treatment material from the road surface or base without substantially interfering with visibility of the reflective portion.

10. The temporary flexible pavement marker of claim 9, the temporary flexible pavement marker being a 4-inch long by 2-inch height temporary pavement marker.

11. The temporary flexible pavement marker of claim 9, the protective rib width being between about 0.02 inches to about 0.09 inches from the stand.

12. The temporary flexible pavement marker of claim 9, the protective shield width being about ½ inch to about 1 inch.

13. The temporary flexible pavement marker of claim 9, the reflective portion being between about ¼ inch and one-inch wide.

14. The temporary flexible pavement marker of claim 9, the protective shield being curved so as to form an arc-shaped protective cover above the first reflective portion.

15. A method of providing temporary pavement markers to a road surface during repair or construction of a road and applying a road surface spray, the method comprising:

placing a temporary flexible pavement marker upon a road surface, the flexible pavement marker including:

a base configured for mounting to said road surface;

a stand flexibly extending from the base, the stand comprising a reflective portion not covered by any protective layer removable therefrom so as to lift road treatment material away from the reflective portion when using the temporary flexible pavement marker during repair or construction of a road; and a protective shield extending a protective shield width from the stand above the reflective portion; and spraying fluid road treatment material at a height above the temporary pavement marker; and protecting the reflective portion of the temporary flexible pavement marker during the spraying of fluid road treatment material using the protective shield so as to maintain the reflective portion in a reflective state responsive to automobile headlights to safely delineate a traffic lane at night or other dark or limited-visibility driving conditions.

16. The method of claim 15 further comprising spreading gravel on the road to cover partially or fully the base of the temporary flexible pavement marker.

17. The method of claim 15, the temporary flexible pavement marker further comprising a protective rib configured for protecting the reflective portion from backsplash of the sprayed fluid road treatment material from the road surface or base during the spraying of fluid road treatment material at a height above the temporary pavement marker.

18. The method of claim 17, the protective rib having a protective rib width of between about 0.02 inches to about 0.09 inches from the stand.

19. The method of claim 17, the protective shield, protective rib, and reflective portion being proportioned so that the reflective portion is substantially protected from the fluid road treatment material during the spraying of fluid road treatment material at a height above the temporary pavement marker.

20. The method of claim 15, the protective shield extending a protective shield width of about ½ inch to about 1 inch from the stand.

* * * * *